US010663910B2

(12) United States Patent
Shimizu

(10) Patent No.: US 10,663,910 B2
(45) Date of Patent: May 26, 2020

(54) DEVELOPING CARTRIDGE INCLUDING ENGAGING MEMBER MOVABLE WITH HELICAL GEAR AND ENGAGEABLE WITH OUTER SURFACE OF HOUSING

(71) Applicant: BROTHER KOGYO KABUSHIKI KAISHA, Nagoya-shi, Aichi-ken (JP)

(72) Inventor: Keita Shimizu, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/229,088

(22) Filed: Dec. 21, 2018

(65) Prior Publication Data

US 2019/0265637 A1 Aug. 29, 2019

(30) Foreign Application Priority Data

Feb. 28, 2018 (JP) ..... 2018-034764

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0865* (2013.01); *G03G 15/0898* (2013.01);
(Continued)

(58) Field of Classification Search
CPC ..... G03G 15/0865; G03G 15/0889; G03G 21/1647; G03G 21/1857; G03G 21/186; G03G 2221/1657
See application file for complete search history.

(56) References Cited

U.S. PATENT DOCUMENTS 10,054,901 B1 * 8/2018 Fukamachi ..... G03G 21/1676
2012/0195634 A1 * 8/2012 Kuriki ..... G03G 15/0808 399/281

(Continued)

FOREIGN PATENT DOCUMENTS

JP 2002-182470 A 6/2002
JP 2005-309034 A 11/2005
JP 2015-129806 A 7/2015

OTHER PUBLICATIONS

Extended European Search Report issued in related European Patent Application No. 18248152.3, dated Jul. 25, 2019.

*Primary Examiner* — Ryan D Walsh
(74) *Attorney, Agent, or Firm* — Merchant & Gould P.C.

(57) ABSTRACT

A developing cartridge includes: a housing; a developing roller rotatable about a first axis extending in an axial direction; a first helical gear and a second helical gear positioned at an outer surface of the housing; and an engaging member movable together with the second helical gear. The second helical gear meshes with the first helical gear and is rotatable in a first rotational direction and a second rotational direction. The second helical gear is movable in the axial direction between a first position and a second position closer to the outer surface than the first position. The second helical gear rotates in the first rotational direction to move toward the first position. The second helical gear rotates in the second rotational direction to move toward the second position whereby the engaging member engages a part of the outer surface to terminate rotation of the second helical gear.

20 Claims, 7 Drawing Sheets

(52) U.S. Cl.
CPC ..... *G03G 21/186* (2013.01); *G03G 21/1857* (2013.01); *G03G 2221/1657* (2013.01)

(56) References Cited

U.S. PATENT DOCUMENTS

| | | | | |
|---|---|---|---|---|
| 2015/0192891 | A1 | 7/2015 | Noda et al. | |
| 2015/0212456 | A1 | 7/2015 | Imaizumi | |
| 2015/0277282 | A1* | 10/2015 | Taguchi | G03G 15/0865 399/12 |
| 2016/0011542 | A1* | 1/2016 | Mori | G03G 21/1857 399/262 |
| 2017/0327327 | A1* | 11/2017 | Kawashima | B65H 1/08 |
| 2018/0095410 | A1* | 4/2018 | Itabashi | G03G 15/0896 |
| 2018/0095411 | A1* | 4/2018 | Itabashi | G03G 15/0896 |

* cited by examiner

DEVELOPING CARTRIDGE INCLUDING ENGAGING MEMBER MOVABLE WITH HELICAL GEAR AND ENGAGEABLE WITH OUTER SURFACE OF HOUSING

CROSS REFERENCE TO RELATED APPLICATION

This application claims priority from Japanese Patent Application No. 2018-034764 filed Feb. 28, 2018. The entire content of the priority application is incorporated herein by reference.

TECHNICAL FIELD

The present disclosure relates to a developing cartridge including a developing roller and a gear rotatable in accordance with rotation of the developing roller.

BACKGROUND

Conventionally, there are known developing cartridges each including a developing roller and gears rotatable in accordance with rotation of the developing roller, such as a developing gear, a supply gear, and an agitator gear, for example.

SUMMARY

In a state where the developing cartridge is attached to an image-forming apparatus, one of the gears rotates in a first rotational direction upon receipt of a driving force from the image-forming apparatus, thereby rotating the developing gear in a prescribed rotational direction to enable the image-forming apparatus to perform image formation. On the other hand, in a case where the gear rotates in a second rotational direction opposite to the first rotational direction, the developing roller is caused to rotate in a direction opposite to the prescribed rotational direction, which may result in leakage of developing agent.

In view of the foregoing, it is an object of the present disclosure to provide a structure capable of restricting a gear rotatable in accordance with rotation of a developing roller from rotating in a direction opposite to a prescribed rotational direction.

In order to attain the above and other objects, according to one aspect, the present disclosure provides a developing cartridge including a housing, a developing roller, a first helical gear, a second helical gear and an engaging member. The housing is configured to accommodate toner therein, and the housing has an outer surface. The developing roller is about a first axis extending in an axial direction. The first helical gear is positioned at the outer surface and is rotatable about a second axis extending in the axial direction. The first helical gear is rotatable in accordance with rotation of the developing roller. The second helical gear is positioned at the outer surface and is rotatable in a first rotational direction and a second rotational direction opposite to the first rotational direction about a third axis extending in the axial direction. The second helical gear is movable in the axial direction between a first position and a second position positioned closer to the outer surface than the first position is to the outer surface. The second gear is moved to the first position by a first thrust force generated by meshing engagement between the first helical gear and the second helical gear in a case where the second helical gear rotates in the first rotational direction. The second helical gear is moved to the second position by a second thrust force generated by the meshing engagement between the first helical gear and the second helical gear in a case where the second helical gear rotates in the second rotational direction. The engaging member is rotatable about the third axis together with the second helical gear and is movable in the axial direction together with the second helical gear. The second helical gear is rotatable in the first rotational direction in accordance with the rotation of the first helical gear in a case where the second helical gear is at the first position. The engaging member is engaged with a part of the outer surface to terminate the rotation of the second helical gear in the second rotational direction in a case where the second helical gear is at the second position.

DETAILED DESCRIPTION

Hereinafter, one embodiment of the disclosure will be described in detail while referring to accompanying drawings.

Figure 1:
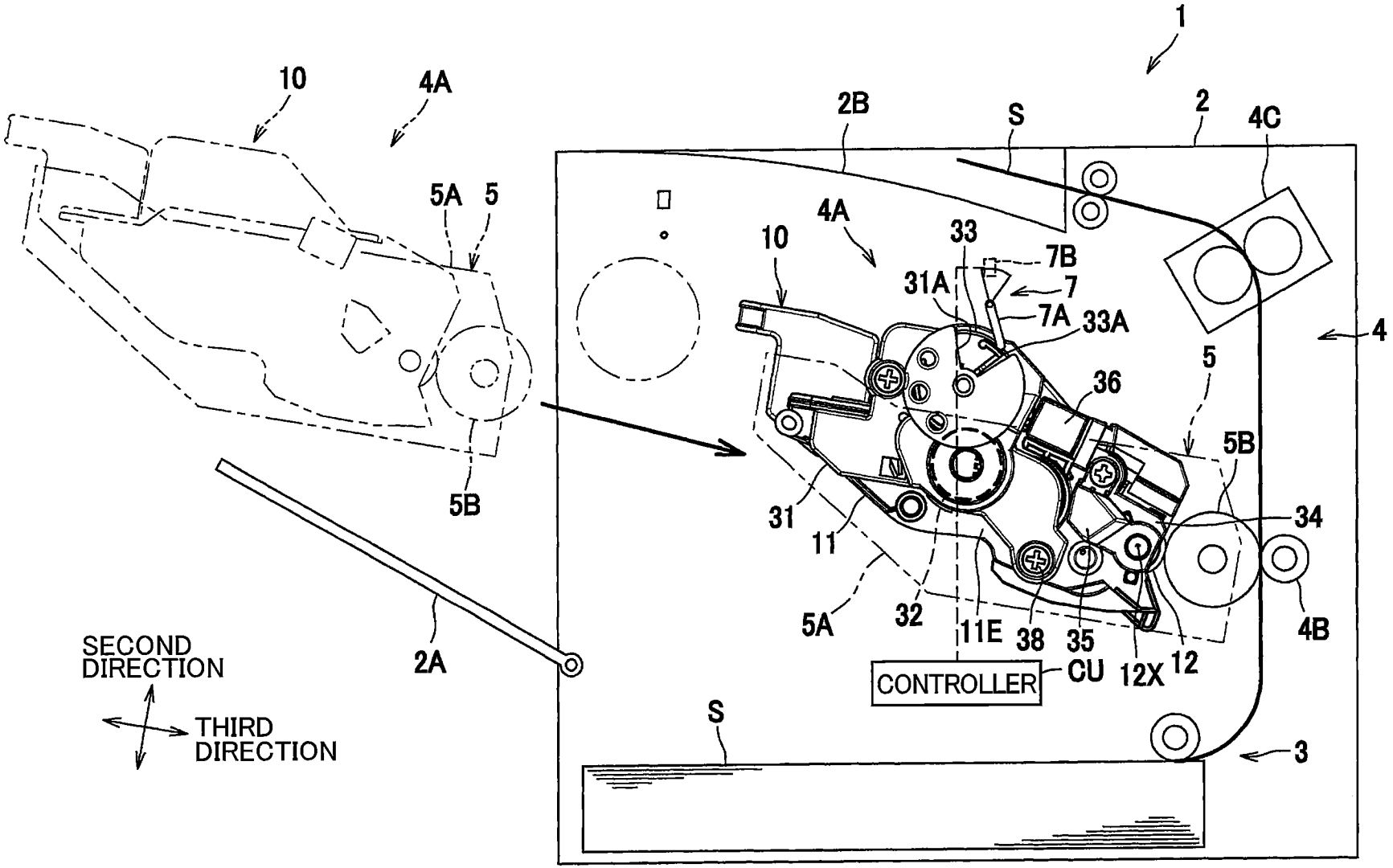
FIG. 1 is a schematic view illustrating an internal structure of a printer that can accommodate a developing cartridge according to an embodiment of the present disclosure.

As illustrated in FIG. 1, a laser printer 1 of the embodiment mainly includes a main casing 2, a sheet feeding portion 3, an image forming portion 4, and a controller CU. The laser printer 1 is an image-forming apparatus configured to form images onto sheets S.

The main casing 2 includes a front cover 2A and a discharge tray 2B. The discharge tray 2B is positioned at an upper portion of the main casing 2. The sheet feeding portion 3 and the image forming portion 4 are disposed within the main casing 2. A developing cartridge 10 according to the embodiment can be attached to and removed from the main casing 2 while the front cover 2A is open.

The sheet feeding portion 3 is configured to accommodate the sheets S therein. The sheet feeding portion 3 is configured to feed the sheets S one by one to the image forming portion 4.

The image forming portion 4 includes a process cartridge 4A, an exposure device (not illustrated), a transfer roller 4B, and a fixing device 4C.

Figure 2:
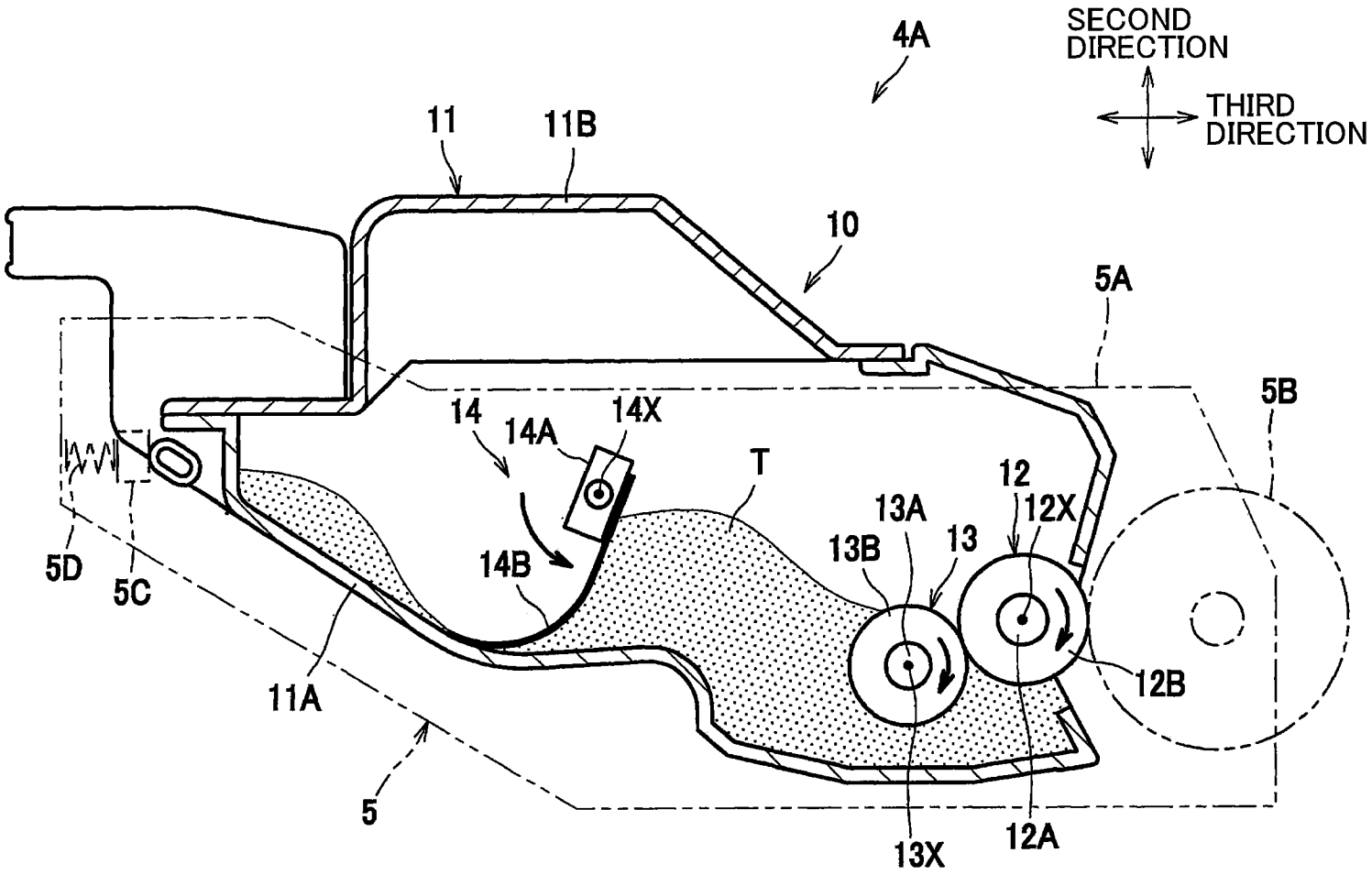
FIG. 2 is a vertical cross-sectional view of a process cartridge including the developing cartridge according to the embodiment.

As illustrated in FIGS. 1 and 2, the process cartridge 4A includes a drum cartridge 5 and the developing cartridge 10. The developing cartridge 10 can be attached to the drum cartridge 5. More specifically, the developing cartridge 10 can be attached to and removed from the drum cartridge 5. With the developing cartridge 10 attached to the drum cartridge 5, the developing cartridge 10 and the drum cartridge 5, as the process cartridge 4A, can be attached to and removed from the main casing 2 of the laser printer 1. The drum cartridge 5 includes a frame 5A, and a photosensitive drum 5B rotatably supported by the frame 5A.

As illustrated in FIG. 2, the developing cartridge 10 includes a housing 11, a developing roller 12, a supply roller 13, and an agitator 14.

The housing 11 includes a container 11A and a cover 11B. The container 11A of the housing 11 can accommodate toner T therein.

The developing roller 12 includes a developing-roller shaft 12A and a roller body 12B. The developing-roller shaft 12A and the roller body 12B extend in a first direction. The first direction denotes an axial direction of the developing roller 12 and will be referred to simply as the axial direction, hereinafter. The developing-roller shaft 12A defines a first axis 12X extending in the axial direction. The developing-roller shaft 12A is made of metal, for example. The roller body 12B is provided over an outer peripheral surface of the developing-roller shaft 12A. The roller body 12B is made of an electrically conductive rubber, for example.

The developing roller 12 is rotatable about the first axis 12X of the developing-roller shaft 12A extending in the axial direction. The developing roller 12 is rotatably supported by the housing 11 so as to be rotatable about the first axis 12X of the developing-roller shaft 12A. That is, the roller body 12B is rotatable together with the developing-roller shaft 12A. The developing roller 12 is applied with a developing bias from the controller CU.

The container 11A and the cover 11B of the housing 11 face each other in a second direction. The second direction crosses the first direction. Preferably, the second direction is orthogonal to the first direction. The developing roller 12 is positioned at one end portion of the housing 11 in a third direction. The third direction crosses the first direction and the second direction. Preferably, the third direction is orthogonal to the first direction and the second direction.

The supply roller 13 includes a supply-roller shaft 13A and a roller body 13B. The supply-roller shaft 13A and the roller body 13B extend in the first direction. The supply-roller shaft 13A defines an axis 13X extending in the axial direction. The supply-roller shaft 13A is made of metal, for example. The roller body 13B is provided over an outer peripheral surface of the supply-roller shaft 13A. The roller body 13B is made of a sponge material, for example. The supply roller 13 is rotatable about the axis 13X of the supply-roller shaft 13A extending in the axial direction. The roller body 13B is rotatable together with the supply-roller shaft 13A.

The agitator 14 includes an agitator shaft 14A and a flexible sheet 14B. The agitator shaft 14A defines an axis 14X extending in the axial direction. The agitator shaft 14A is rotatable about the axis 14X. The agitator shaft 14A is rotatably supported by the housing 11 so as to be rotatable about the axis 14X. The agitator 14 is rotatable in accordance with rotation of a coupling 22 described later. The flexible sheet 14B has a base end fixed to the agitator shaft 14A. The flexible sheet 14B has a tip end configured to contact an inner surface of the housing 11. In accordance with rotation of the agitator 14, the agitator 14 is configured to agitate the toner T with the flexible sheet 14B.

The drum cartridge 5 includes a pressing member 5C and an urging member 5D. The urging member 5D is configured to urge the pressing member 5C toward the photosensitive drum 5B. The pressing member 5C urged by the urging member 5D is configured to contact the developing cartridge 10 attached to the drum cartridge 5 and urge the developing roller 12 against the photosensitive drum 5B. Hence, in a state where the developing cartridge 10 is attached to the drum cartridge 5, the developing roller 12 is pressed against the photosensitive drum 5B by the pressing member 5C and the urging member 5D.

As illustrated in FIG. 1, the transfer roller 4B faces the photosensitive drum 5B. The transfer roller 4B is configured to convey the sheet S with the sheet S nipped between the photosensitive drum 5B and the transfer roller 4B.

The photosensitive drum 5B is configured to be charged by a charger (not illustrated), and then exposed to light by the exposure device. An electrostatic latent image is thus formed on a peripheral surface of the photosensitive drum 5B. The toner T is then supplied to the electrostatic latent image to form a toner image on the photosensitive drum 5B. The toner image on the photosensitive drum 5B is then transferred onto the sheet S fed from the sheet feeding portion 3 while the sheet S passes between the photosensitive drum 5B and the transfer roller 4B.

After the toner image is transferred onto the sheet S, the fixing device 4C is configured to thermally fix the toner image to the sheet S. After the toner image is thermally-fixed to the sheet S, the sheet S is discharged out of the main casing 2 onto the discharge tray 2B.

The controller CU is configured to control overall operations of the laser printer 1.

The laser printer 1 includes a sensor 7. The sensor 7 is configured to detect whether the attached developing cartridge 10 is new, or a specification of the attached developing cartridge 10. The sensor 7 includes a lever 7A and an optical sensor 7B. The lever 7A is pivotably supported by the main casing 2. The lever 7A is disposed at such a position that the lever 7A can come into contact with detection protrusions 33A of a detection gear 33 (described later). The detection protrusions 33A can rotate together with the detection gear 33. The optical sensor 7B is electrically connected to the controller CU so that the optical sensor 7B can output a detection signal to the controller CU. The controller CU is configured to identify the specification of the attached developing cartridge 10, for example, based on the signal received from the optical sensor 7B. The optical sensor 7B is configured to detect displacement of the lever 7A and transmit a detection signal to the controller CU based on the detection. Specifically, the optical sensor 7B may be a sensor unit configured of a light emitter and a light receiver, for example.

Next, a detailed configuration of the developing cartridge 10 according to the embodiment will be described.

Figure 3:
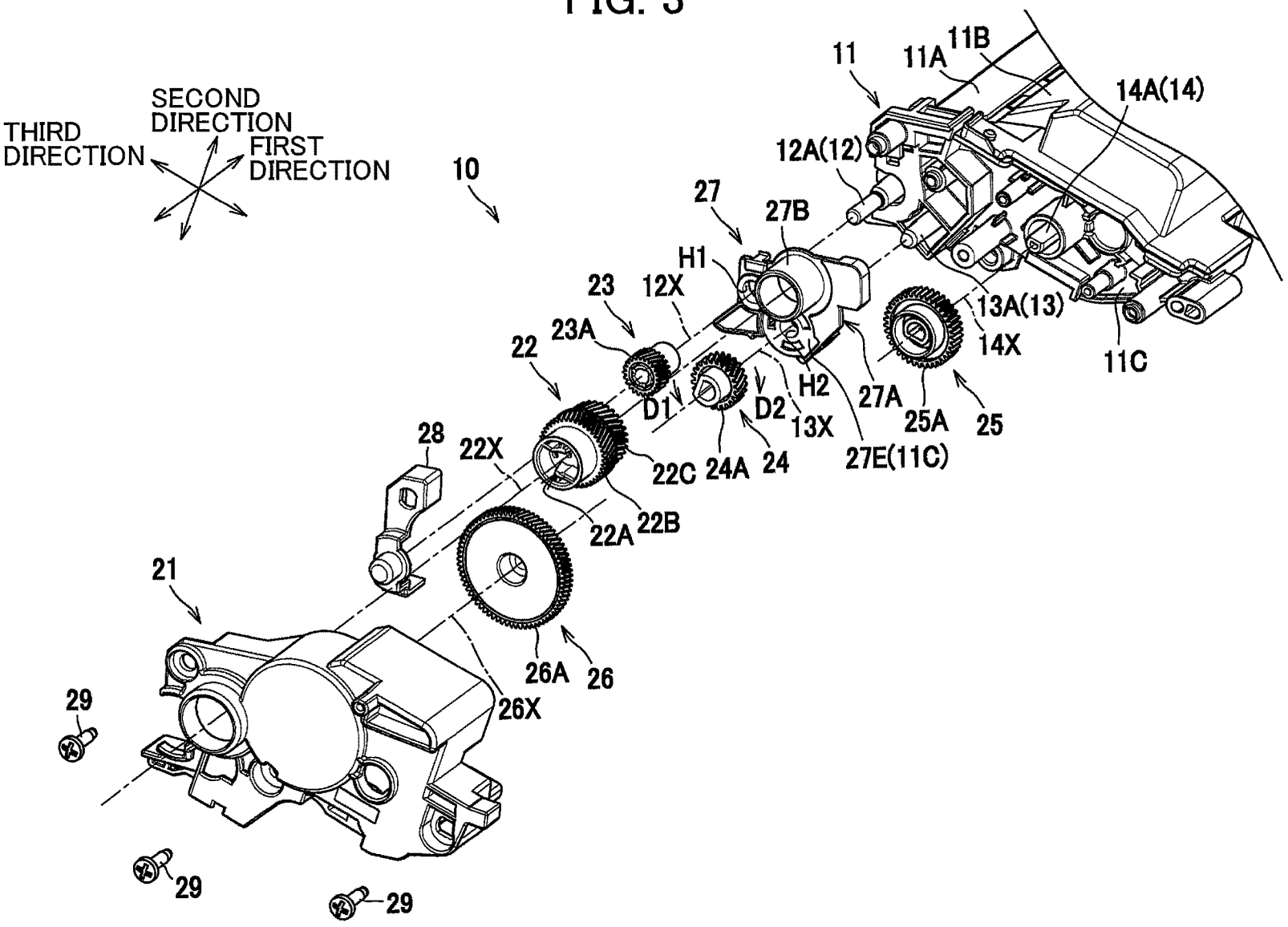
FIG. 3 is an exploded perspective view illustrating components constituting one end portion of the developing cartridge according to the embodiment in a first direction.

As illustrated in FIG. 3, the developing cartridge 10 includes the housing 11. The housing 11 has one end portion in the first direction. A first gear cover 21, the coupling 22, a developing gear 23, a supply gear 24, a first agitator gear 25, an idle gear 26, a first bearing member 27, and a cap 28 are disposed at the one end portion of the housing 11 in the first direction.

The first gear cover 21 includes a shaft (not illustrated) for supporting the idle gear 26. The first gear cover 21 also covers at least one of the gears positioned at the one end portion of the housing 11 in the first direction. Specifically, the first gear cover 21 covers a portion of the coupling 22, the supply gear 24, the first agitator gear 25, and the idle gear 26. The first gear cover 21 is fixed to an outer surface 11C of the housing 11 with screws 29. That is, the first gear cover 21 is positioned at the outer surface 11C. The outer surface 11C is an outer surface of the one end portion of the housing 11 in the first direction.

The coupling 22 is configured to rotate the gears including the developing roller 12. The coupling 22 is rotatable in accordance with rotations of the developing roller 12 and other gears. The coupling 22 is rotatable about an axis 22X thereof extending in the axial direction. The coupling 22 is positioned at the one end portion of the housing 11 in the first direction. That is, the coupling 22 is positioned at the outer surface 11C. The coupling 22 is rotatable upon receipt of a driving force.

Specifically, the coupling 22 is configured to receive the driving force from the laser printer 1. The coupling 22 is rotatable by engagement with a driving member (not illustrated) provided in the laser printer 1. The coupling 22 has one end in the axial direction formed with a first recess 22A. The first recess 22A is recessed inward in the first direction. The first recess 22A is configured to receive the driving member to engage therewith. More specifically, the first recess 22A is configured to engage the driving member of the laser printer 1 to receive the driving force from the laser printer 1.

The coupling 22 includes a first gear 22B and a second gear 22C. The first gear 22B meshingly engages with the developing gear 23. The second gear 22C meshingly engages with the supply gear 24. The first gear 22B has a diameter that is different from a diameter of the second gear 22C. Specifically, the diameter of the first gear 22B is greater than the diameter of the second gear 22C.

The developing gear 23 is mounted to the developing-roller shaft 12A. The developing gear 23 is rotatable together with the developing roller 12 about the first axis 12X. The developing gear 23 is positioned at the one end portion of the housing 11 in the first direction. That is, the developing gear 23 is positioned at the outer surface 11C. The developing gear 23 includes a gear portion 23A. The gear portion 23A meshingly engages with the first gear 22B of the coupling 22.

The supply gear 24 is mounted to the supply-roller shaft 13A. The supply gear 24 is rotatable together with the supply roller 13 about the axis 13X extending in the axial direction. The supply gear 24 is positioned at the one end portion of the housing 11 in the first direction. That is, the supply gear 24 is positioned at the outer surface 11C. The supply gear 24 includes a gear portion 24A. The gear portion 24A meshingly engages with the second gear 22C of the coupling 22. The supply gear 24 is rotatable in a first rotation direction D1 upon receipt of the driving force from the coupling 22. The supply gear 24 is also rotatable in a second rotation direction D2 opposite to the first rotation direction D1. That is, the supply gear 24 is rotatably supported by the housing 11 so as to be rotatable in the first rotation direction D1 and the second rotation direction D2.

The first agitator gear 25 is mounted to the agitator shaft 14A. The first agitator gear 25 is rotatable about the axis 14X extending in the axial direction. The first agitator gear 25 is rotatable together with the agitator 14 in accordance with rotation of the coupling 22. The first agitator gear 25 is positioned at the one end portion of the housing 11 in the first direction. That is, the first agitator gear 25 is positioned at the outer surface 11C. The first agitator gear 25 includes a gear portion 25A. The gear portion 25A meshingly engages with the idle gear 26.

The idle gear 26 is positioned at the one end portion of the housing 11 in the first direction. That is, the idle gear 26 is positioned at the outer surface 11C. The idle gear 26 meshingly engages with the coupling 22 and the first agitator gear 25. Specifically, the idle gear 26 includes a large-diameter portion 26A and a small-diameter portion 26B (see FIG. 6). The large-diameter portion 26A meshingly engages with the first gear 22B of the coupling 22. The small-diameter portion 26B meshingly engages with the gear portion 25A of the first agitator gear 25. The idle gear 26 is rotatably supported by the shaft (not illustrated) of the first gear cover 21. The idle gear 26 is rotatable about an axis 26X extending in the axial direction. The idle gear 26 functions to slow down a rotation speed of the coupling 22 and transmit the same to the first agitator gear 25. In the first direction, the large-diameter portion 26A is positioned farther away from the housing 11 than the small-diameter portion 26B is from the housing 11.

The cap 28 covers one end portion of the developing-roller shaft 12A in the first direction. The cap 28 may be made of resin whose type is different from a type of resin which the first gear cover 21 is made of.

The first bearing member 27 rotatably supports the developing-roller shaft 12A, the supply-roller shaft 13A, and the coupling 22. The first bearing member 27 is secured to the one end portion of the housing 11 in the first direction. The first bearing member 27 includes a base portion 27A and a shaft 27B. The shaft 27B protrudes from the base portion 27A outward in the first direction.

The base portion 27A has a first insertion hole H1 and a second insertion hole H2. The developing-roller shaft 12A of the developing roller 12 is inserted in the first insertion hole H1. The supply-roller shaft 13A of the supply roller 13 is inserted in the second insertion hole H2.

The shaft 27B has a cylindrical shape. The shaft 27B rotatably supports the coupling 22. Specifically, an outer peripheral surface of the shaft 27B rotatably supports the coupling 22. An inner end of the shaft 27B (another end in the first direction) is closed by the base portion 27A.

As illustrated in FIG. 1, the developing cartridge 10 also includes a second gear cover 31, a second agitator gear 32, the detection gear 33, a second bearing member 34, a developing electrode 35, and a supply electrode 36, all of which are positioned at another end portion of the housing 11 in the first direction.

The second gear cover 31 covers at least a portion of the detection gear 33. The second gear cover 31 is positioned at an outer surface 11E of the housing 11. The outer surface 11E is an outer surface positioned at the other end portion of the housing 11 in the first direction. That is, the outer surface 11E is opposite the outer surface 11C in the first direction. The second gear cover 31 has an opening 31A formed therein. The portion of the detection gear 33 is exposed through the opening 31A.

The second agitator gear 32 is positioned at the other end portion of the housing 11 in the first direction. That is, the second agitator gear 32 is positioned at the outer surface 11E. The second agitator gear 32 is mounted to the agitator shaft 14A (see FIG. 2). The second agitator gear 32 is thus rotatable together with the agitator shaft 14A of the agitator 14 about the axis 14X extending in the axial direction.

The detection gear 33 is positioned at the other end portion of the housing 11 in the first direction. The detection gear 33 is rotatable by rotation of the second agitator gear 32 when the detection gear 33 comes to meshing engagement with the second agitator gear 32. The detection gear 33 includes a plurality of the detection protrusions 33A each configured to come into contact with the lever 7A of the sensor 7. Note that the number/positions of the detection protrusions 33A may be varied according to the specifications of the developing cartridge 10 so that the controller CU can identify the specification of the developing cartridge 10 in a state where the developing cartridge 10 is attached to the main casing 2 of the laser printer 1.

The second bearing member 34 rotatably supports the developing-roller shaft 12A and the supply-roller shaft 13A. The second bearing member 34 is fixed to the outer surface 11E while supporting the developing-roller shaft 12A and the supply-roller shaft 13A.

The developing electrode 35 is positioned at the other end of the housing 11 in the first direction. The developing electrode 35 is configured to supply electric power to the developing-roller shaft 12A. The developing electrode 35 is made of an electrically conductive resin, for example.

The supply electrode 36 is positioned at the other end of the housing 11 in the first direction. The supply electrode 36 is configured to supply electric power to the supply-roller shaft 13A. The supply electrode 36 is made of an electrically conductive resin, for example.

The developing electrode 35 and the supply electrode 36 are screw-fixed to the outer surface 11E of the housing 11, together with the second bearing member 34, with screws 38.

In the present embodiment, the coupling 22 serves as an example of a first helical gear, and the supply gear 24 serves as an example of a second helical gear. More specifically, as illustrated in FIG. 3, the second gear 22C of the coupling 22 is a helical gear with each gear tooth inclined relative to the first direction and a rotation direction of the coupling 22. The gear portion 24A of the supply gear 24 is a helical gear with each gear tooth inclined relative to the first direction and a rotation direction of the supply gear 24. Here, the rotation direction of the supply gear 24 includes the first rotation direction D1 and second rotation direction D2.

Figure 4:
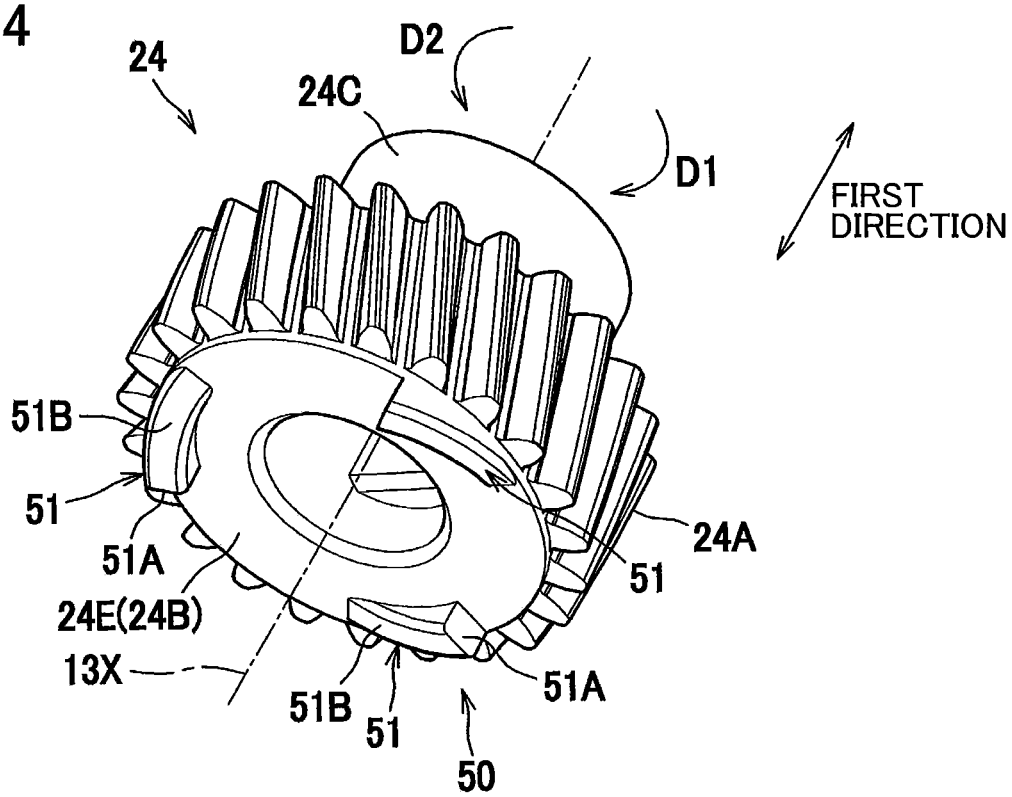
FIG. 4 is a perspective view of a supply gear of the developing cartridge according to the embodiment as viewed from a point inward thereof in the first direction.

As illustrated in FIG. 4, the supply gear 24 includes the gear portion 24A, a disc portion 24B, a shaft portion 24C, and an engaging member 50.

The disc portion 24B has a disc shape centered on the axis 13X. The disc portion 24B has an end surface 24E facing a portion of the outer surface 11C in the first direction. That is, the end surface 24E faces inward in the first direction.

The shaft portion 24C extends inward in the first direction from a center portion of the disc portion 24B. The shaft portion 24C has a cylindrical shape centered on the axis 13X. The shaft portion 24C of the supply gear 24 is supported such that the shaft portion 24C is movable in the axial direction relative to the supply-roller shaft 13A (see FIG. 3).

The supply gear 24 is movable between a first position (illustrated in FIG. 6) and a second position (illustrated in FIG. 7) in the axial direction. The supply gear 24 is positioned farther away from the outer surface 11C at the first position than at the second position in the first direction. At the first position, the engaging member 50 and a part of the outer surface 11C (first holes 41 described later) are disengaged from each other. That is, at the first position, the engaging member 50 and the part of the outer surface 11C do not engage each other.

The supply gear 24 is positioned closer to the outer surface 11C at the second position than at the first position in the first direction. At the second position, the engaging member 50 and the part of the outer surface 11C (the first holes 41) are engaged with each other. More specifically, at the second position, the engaging member 50 and the part of the outer surface 11C (a first surface 41A of each first hole 41 described later) are in engagement with each other in the second rotation direction D2.

As the supply gear 24 rotates, the gear portion 24A of the supply gear 24 and the second gear 22C of the coupling 22 generate a thrust force. Specifically, as the supply gear 24 rotates in the first rotation direction D1, the gear portion 24A and the second gear 22C generate a first thrust force F1 that causes the supply gear 24 to move outward in the first direction. In other words, as the supply gear 24 rotates in the first rotation direction D1, the gear portion 24A and the second gear 22C generate the first thrust force F1, with which force the supply gear 24 is caused to move toward the first gear cover 21 (see FIG. 3) in the first direction. Thus, in a case where the supply gear 24 rotates in the first rotation direction D1, the supply gear 24 is moved to the first position by the first thrust force F1 generated by the meshing engagement between the supply gear 24 and the coupling 22.

As the supply gear 24 rotates in the second rotation direction D2, the gear portion 24A and the second gear 22C generate a second thrust force F2. The second thrust force F2 causes the supply gear 24 to move inward in the first direction. In other words, as the supply gear 24 rotates in the second rotation direction D2, the gear portion 24A and the second gear 22C generate the second thrust force F2, with which force the supply gear 24 is caused to move toward the outer surface 11C in the first direction. In a case where the supply gear 24 rotates in the second rotation direction D2, the supply gear 24 is moved to the second position by the second thrust force F2 generated by the meshing engagement between the coupling 22 and the supply gear 24.

Note that the coupling 22 is immovable in the axial direction relative to the housing 11, since the coupling 22 is in contact with the first gear cover 21 (see FIG. 3) or the first bearing member 27. In the present disclosure, the description "immovable in the axial direction relative to the housing 11" includes both cases: the coupling 22 does not move at all relative to the housing 11; and the coupling 22 does move slightly relative to the housing 11 due to play or backlash therebetween.

The engaging member 50 illustrated in FIG. 4 serves to allow rotation of the supply gear 24 in the first rotation direction D1. The engaging member 50 further serves to restrict rotation of the supply gear 24 in the second rotation direction D2.

The engaging member 50 is rotatable about the axis 13X together with the supply gear 24. Specifically, the engaging member 50 is rotatable, together with the supply gear 24, in the first rotation direction D1 and in the second rotation direction D2.

The engaging member 50 is also movable in the axial direction together with the supply gear 24. Specifically, the engaging member 50 is movable in the axial direction between the first position (illustrated in FIG. 6) and the second position (illustrated in FIG. 7) together with the supply gear 24. While the supply gear 24 is at the first position, the engaging member 50 and the part of the outer surface 11C (the first holes 41) are disengaged from each other. While the supply gear 24 is at the second position, the engaging member 50 and the part of the outer surface 11C are engaged with each other.

While the supply gear 24 is at the first position, the engaging member 50 is also at the first position together with the supply gear 24. At this time, the supply gear 24 is rotatable in conjunction with rotations of the coupling 22 and the developing gear 23, for example. While the supply gear 24 is at the second position, the engaging member 50 is also at the second position together with the supply gear 24. At this time, the engaging member 50 and the part of the outer surface 11C are in engagement with each other. The engagement between the engaging member 50 and the part of the outer surface 11C prevents the supply gear 24 from rotating further in the second rotation direction D2.

As illustrated in FIG. 3, in the present embodiment, the first gear 22B of the coupling 22, the gear portion 23A of the developing gear 23, and the large-diameter portion 26A of the idle gear 26 are also helical gears with each gear tooth inclined relative to the first direction and corresponding rotation direction. In the embodiment, the developing gear 23 and the idle gear 26 are also immovable in the axial direction relative to the housing 11, similar to the coupling 22.

Specifically, the developing gear 23 is immovable in the axial direction relative to the housing 11, since the developing gear 23 is in contact with the first gear cover 21 or the first bearing member 27. Alternatively, the developing gear 23 may be fixed to the developing-roller shaft 12A in order to make the developing gear 23 immovable in the axial direction relative to the housing 11. Further, the idle gear 26 is also immovable in the axial direction relative to the housing 11, since the idle gear 26 is in contact with the housing 11 or the first gear cover 21.

In the embodiment, the first bearing member 27 constitutes the part of the outer surface 11C of the housing 11. Specifically, the first bearing member 27 is positioned at one end portion of the container 11A in the first direction. The first bearing member 27 has a side surface 27E positioned at one end portion of the base portion 27A in the first direction. The side surface 27E of the first bearing member 27 constitutes the part of the outer surface 11C. In other words, the first bearing member 27 constitutes the housing 11 of the developing cartridge 10 together with the container 11A and the cover 11B.

The coupling 22, the developing gear 23, and the supply gear 24 are positioned at the one end portion of the base portion 27A in the first direction. In other words, the base portion 27A of the first bearing member 27 is positioned between the container 11A and the coupling 22, the developing gear 23, and the supply gear 24 in the first direction.

Figure 5:
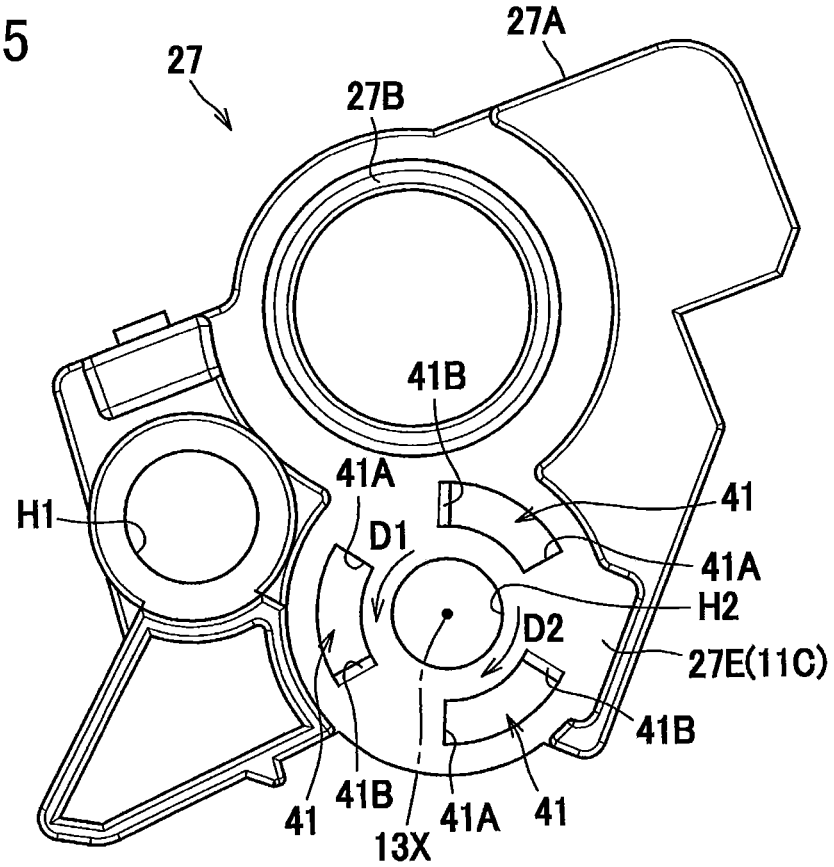
FIG. 5 is perspective view of a first bearing member of the developing cartridge according to the embodiment as viewed from a point outward thereof in the first direction.

As illustrated in FIG. 5, the first bearing member 27 has the plurality of first holes 41. Specifically, the first bearing member 27 has three of the first holes 41. Each of the first holes 41 has an arcuate shape centered on the axis 13X. Each first hole 41 penetrates through the base portion 27A in the axial direction. The plurality of first holes 41 is positioned to surround the second insertion hole H2. The first holes 41 are aligned with one another at equal intervals in the rotation direction of the supply gear 24. The plurality of first holes 41 are arranged to form an annular shape. Each of the first holes 41 has a first surface 41A and a second surface 41B. The first surface 41A extends in the first direction. The second surface 41B is inclined relative to the first direction.

The first surfaces 41A function to restrict the supply gear 24 from rotating in the second rotation direction D2. The first surfaces 41A extend to cross the rotation direction of the supply gear 24. Preferably, the first surfaces 41A are orthogonal to the rotation direction of the supply gear 24. As the supply gear 24 rotates in the second rotation direction D2, the first surfaces 41A face the engaging member 50 and come into contact therewith in the second rotation direction D2. The first surfaces 41A thus prevent rotation of the supply gear 24 in the second rotation direction D2.

The second surfaces 41B function to move the supply gear 24 and the engaging member 50 from the second position toward the first position in accordance with rotation of the supply gear 24 in the first rotation direction D1. The second surfaces 41B are inclined relative to the rotation direction of the supply gear 24. Specifically, each second surface 41B is inclined such that the second surface 41B extends outward in the first direction toward downstream in the first rotation direction D1. More specifically, each second surface 41B is inclined such that the second surface 41B approaches the side surface 27E toward downstream in the first rotation direction D1. Hence, as the supply gear 24 rotates in the first rotation direction D1, the second surfaces 41B face and come into contact with the engaging member 50 in the first rotation direction D1. The supply gear 24 thus moves toward the first position as the engaging member 50 moves outward in the first direction over the second surfaces 41B.

As illustrated in FIG. 4, the engaging member 50 is positioned at the end surface 24E of the disc portion 24B of the supply gear 24. The engaging member 50 includes a plurality of first protrusions 51. Specifically, the engaging member 50 includes three of the first protrusions 51. Each of the first protrusions 51 has an arcuate shape centered on the axis 13X. Each first protrusion 51 protrudes inward in the first direction from the end surface 24E of the disc portion 24B. The first protrusions 51 are positioned around the axis 13X. The first protrusions 51 are aligned with one another at equal intervals in the rotation direction of the supply gear 24. The first protrusions 51 are arranged to form an annular shape.

The first protrusions 51 are formed integrally with the disc portion 24B. The first protrusions 51 are part of the supply gear 24. That is, the supply gear 24 includes the plurality of first protrusions 51. Put different way, the supply gear 24 includes the engaging member 50.

Each first protrusion 51 has a third surface 51A and a fourth surface 51B. The third surface 51A extends in the first direction. The fourth surface 51B is inclined relative to the first direction.

The third surfaces 51A function to restrict the supply gear 24 from rotating in the second rotation direction D2. The third surfaces 51A extend to cross the rotation direction of the supply gear 24. Preferably, the third surfaces 51A are orthogonal to the rotation direction of the supply gear 24. The third surfaces 51A are configured to come into contact with the respective first surfaces 41A of the first holes 41. More specifically, the third surfaces 51A are configured to make surface-contact with the corresponding first surfaces 41A.

The fourth surfaces 51B function to move the supply gear 24 from the second position to the first position while the supply gear 24 rotates in the first rotation direction D1. The fourth surfaces 51B are each inclined relative to the rotation direction of the supply gear 24. Specifically, each fourth surface 51B is inclined such that the fourth surface 51B extends outward in the first direction toward downstream in the first rotation direction D1. That is, the fourth surfaces 51B are inclined such that the fourth surface 51B approaches the end surface 24E toward downstream in the first rotation direction D1. The fourth surfaces 51B are configured to contact the second surfaces 41B of the first holes 41, respectively. Specifically, the fourth surfaces 51B are respectively configured to make surface-contact with the second surfaces 41B.

Note that a moving distance of the supply gear 24 from the second position to the first position is greater than a length of each first protrusion 51 in the first direction. With this structure, when the supply gear 24 is at the first position, the engagement between the first protrusions 51 and the first holes 41 of the first bearing member 27 can be reliably released. Hence, when the supply gear 24 is at the first position, the first protrusions 51 can be reliably separated from the side surface 27E of the first bearing member 27, i.e., the outer surface 11C in the first direction. The first protrusions 51 and the outer surface 11C can thus be prevented from interfering with each other in a case where the supply gear 24 rotates in the first rotation direction D1 together with the engaging member 50.

Next, operations of the developing cartridge 10 will be described. Specifically, operations of the developing cartridge 10 attached to the drum cartridge 5 will be described hereinafter. That is, description will be given on how the supply gear 24 operates while rotating in the first rotation direction D1 or in the second rotation direction D2 in a state where the developing roller 12 is pressed against the photosensitive drum 5B by the pressing member 5C and the urging member 5D.

Figure 6:
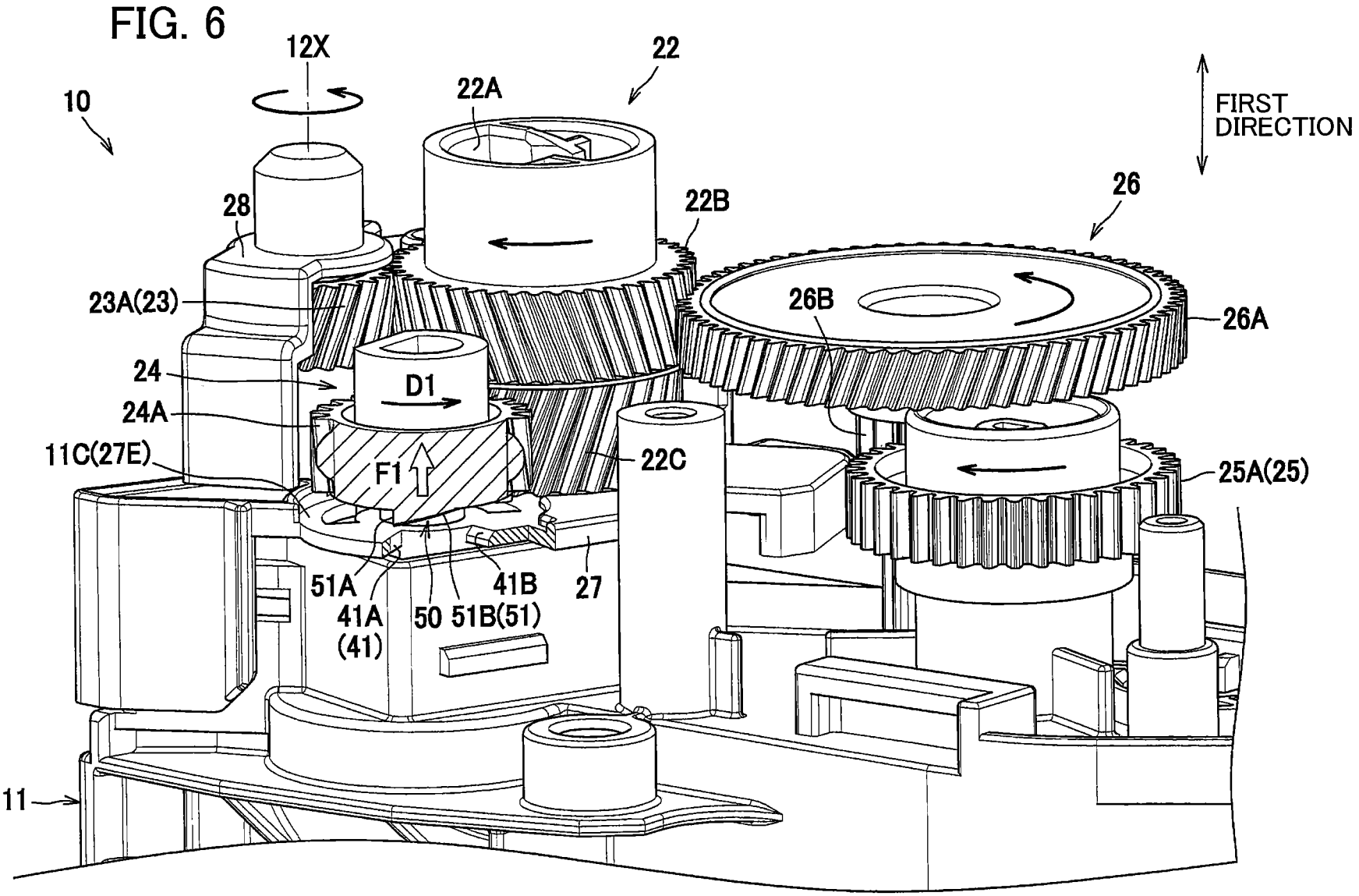
FIG. 6 is a perspective view illustrating gears and an outer surface of a housing of the developing cartridge according to the embodiment in a state where the supply gear is at a first position.

As illustrated in FIG. 6, when the supply gear 24 is at the first position, the first protrusions 51 of the engaging member 50 are separated away from the outer surface 11C of the housing 11 in the axial direction. In other words, the first protrusions 51 are separated away from the side surface 27E of the first bearing member 27 in the axial direction. Hence, at this time, the first protrusions 51 and the first holes 41 of the first bearing member 27 are disengaged from each other.

As the coupling 22 rotates upon receipt of a driving force from the laser printer 1 for printing in the state where the supply gear 24 is at the first position, the supply gear 24 is caused to rotate in the first rotation direction D1. In accordance with rotation of the coupling 22, the developing gear 23, the idle gear 26, and the first agitator gear 25 are also caused to rotate. The developing roller 12, the supply roller 13, and the agitator 14 thus rotate respectively in prescribed directions, as illustrated by arrows in FIG. 2.

Here, there are conventionally known image forming apparatuses that can form images on both sides of each sheet. In order to perform such both-side printing, conventional image forming apparatuses are configured to form image on one side of a sheet at an image forming portion, then reverse the sheet and convey the reversed sheet back to a position upstream of the image forming portion in a sheet-conveying direction, and subsequently form an image on the back side of the sheet.

In such conventional image forming apparatuses, a photosensitive drum may be caused to rotate in a predetermined direction for performing image formation on each sheet, whereas the photosensitive drum may be rotated in a direction opposite to the predetermined direction in order to reverse the sheet. In this configuration, a developing roller may be caused to rotate in reverse following the reverse rotation of the photosensitive drum. However, the structure according to the embodiment can prevent the developing roller 12 from rotating in reverse following the reverse rotation of the photosensitive drum 5B.

Figure 7:
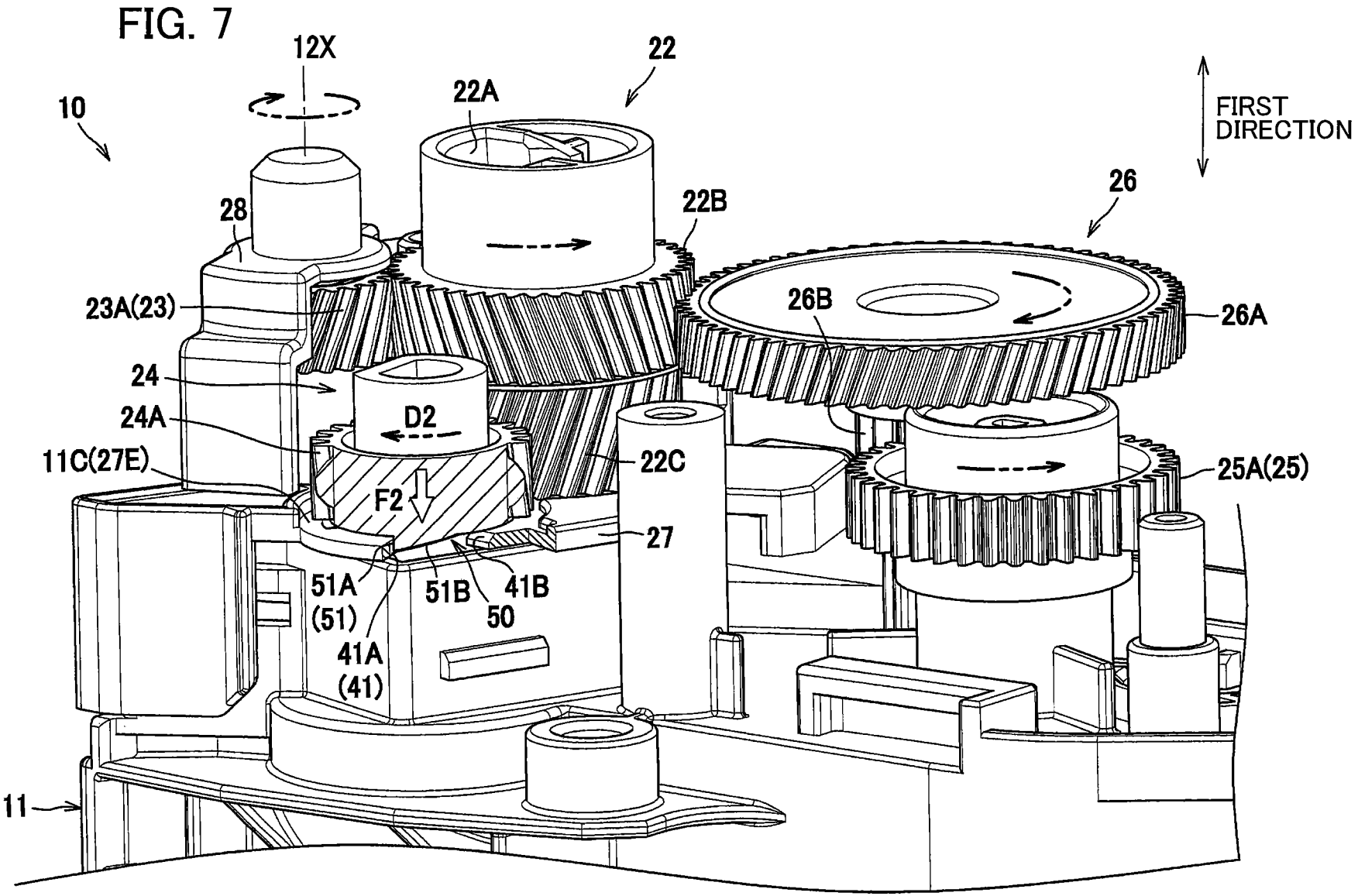
FIG. 7 is a perspective view illustrating the gears and the outer surface of the housing of the developing cartridge according to the embodiment in a state where the supply gear is at a second position.

Specifically, in the present embodiment, in a case where the developing roller 12 rotates in reverse due to the reverse rotation of the photosensitive drum 5B while the supply gear 24 is at the first position illustrated in FIG. 6, the supply gear 24 is rotated in the second rotation direction D2 through rotations of the developing gear 23 and the coupling 22. As a result, as illustrated in FIG. 7, the supply gear 24 is caused to move toward the second position by the second thrust force F2 generated by the meshing engagement between the coupling 22 and the supply gear 24. The supply gear 24 is positioned closer to the side surface 27E (the outer surface 11C) of the first bearing member 27 at the second position than at the first position.

When the supply gear 24 arrives at the second position, the first protrusions 51 of the engaging member 50 engages the corresponding first holes 41 of the first bearing member 27. Since the supply gear 24 is rotating in the second rotation direction D2 at this time, the engaging member 50 also rotates in the second rotation direction D2 together with the supply gear 24. The third surfaces 51A of the first protrusions 51 of the engaging member 50 thus come into contact with the first surfaces 41A of the first holes 41, respectively. This contact prevents the engaging member 50 from rotating further in the second rotation direction D2. The supply gear 24 integral with the engaging member 50 is thus prevented from rotating further in the second rotation direction D2.

In response to halt of the rotation of the supply gear 24, rotations of the coupling 22, rotations of the developing gear 23, the idle gear 26, and the first agitator gear 25 are also terminated. The developing roller 12, the supply roller 13, and the agitator 14 are caused to stop rotating, accordingly. The developing roller 12, the supply roller 13, and the agitator 14 are therefore prevented from rotating in reverse.

The coupling 22 rotates upon receipt of the driving force from the laser printer 1 while the supply gear 24 is at the second position. As the coupling 22 rotates, the supply gear 24 is caused to rotate in the first rotation direction D1. The supply gear 24 is therefore moved from the second position toward the first position by the first thrust force F1 generated by the meshing engagement between the coupling 22 and the supply gear 24.

As the supply gear 24 rotates in the first rotation direction D1, the engaging member 50 also rotates in the first rotation direction D1 together with the supply gear 24. The fourth surfaces 51B of the first protrusions 51 of the engaging member 50 are brought into contact with the second surfaces 41B of the first holes 41, respectively. As the engaging member 50 further rotates in the first rotation direction D1 together with the supply gear 24, the fourth surfaces 51B respectively move over the corresponding second surfaces 41B. The engaging member 50 thus moves toward the first position together with the supply gear 24. In this way, the second surfaces 41B and the fourth surfaces 51B serve to assist movement of the engaging member 50 and the supply gear 24 from the second position to the first position.

As illustrated in FIG. 6, when the supply gear 24 arrives at the first position, the supply gear 24 comes into contact with the first gear cover 21 (see FIG. 3). The supply gear 24 is thus prevented from moving further outward in the first direction. When the supply gear 24 arrives at the first position, the first protrusions 51 of the engaging member 50 are disengaged from the respective first holes 41 of the first bearing member 27. The supply gear 24 can therefore continue to rotate in the first rotation direction D1 thereafter.

The operations described above can also be realized even in a state where the developing cartridge 10 is removed from the drum cartridge 5.

The embodiment described above can achieve technical and operational advantages described below.

As the supply gear 24 rotates in the first rotation direction D1, the engaging member 50 also rotates together with the supply gear 24. In a case where the supply gear 24 is rotated in the second rotation direction D2, the supply gear 24 rotates slightly in the second rotation direction D2 but is then caused to stop rotating due to the engagement of the engaging member 50 with the first surfaces 41A of the first holes 41. The supply gear 24 is thus restricted from rotating further in the second rotation direction D2 opposite to the first rotation direction D1. With this structure of the embodiment, leakage of the toner T out of the housing 11 due to the reverse rotation of the developing roller 12 can be suppressed.

While the supply gear 24 is at the first position, the first protrusions 51 of the engaging member 50 are disengaged from the first holes 41 of the first bearing member 27. That is, the engaging member 50 is in separation from the housing 11. With this structure, while the supply gear 24 is at the first position, the supply gear 24 is reliably rotatable in the first rotation direction D1.

Further, the supply gear 24 can be restricted from rotating in the second rotation direction D2 by the first surfaces 41A and the third surfaces 51A that are orthogonal to the rotation direction of the supply gear 24. Also, movement of the supply gear 24 and the engaging member 50 from the second position to the first position can be assisted by the second surfaces 41B and the fourth surfaces 51B both inclined relative to the rotation direction of the supply gear 24.

The first bearing member 27 has the plurality of first holes 41. The engaging member 50 includes the plurality of first protrusions 51. As the supply gear 24 rotates in the second rotation direction D2, the plurality of the third surfaces 51A of the first protrusions 51 respectively comes into contact with the plurality of the first surfaces 41A of the first holes 41. With this structure, the supply gear 24 can be reliably restricted from rotating in the second rotation direction D2.

Even in a state where the developing roller 12 is pressed onto the photosensitive drum 5B by the pressing member 5C and the urging member 5D of the drum cartridge 5, the supply gear 24 is rotatable in the first rotation direction D1 but substantially impossible to rotate in the second rotation direction D2.

It would be apparent to those skilled in the art that the embodiment described above is merely an example of the present disclosure and modifications and variations may be made therein without departing from the spirit of the disclosure.

Figure 8:
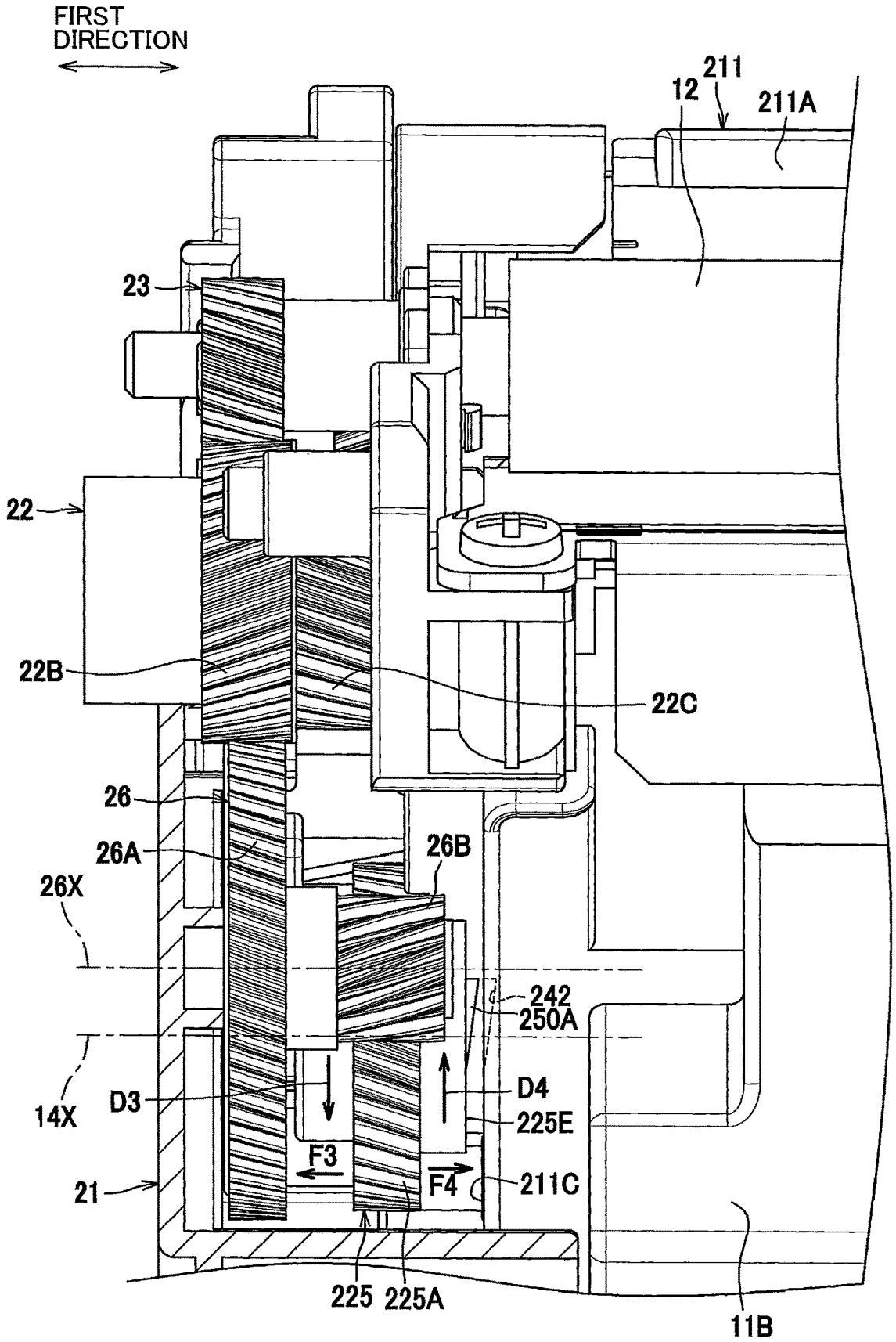
FIG. 8 is a view illustrating gears and a housing of a developing cartridge according to a variation of the embodiment as viewed from a point outward thereof in a second direction.

For example, while the coupling 22 serves as the first helical gear and the supply gear 24 serves as the second helical gear in the depicted embodiment, the present disclosure is not limited to this configuration. For example, as illustrated in FIG. 8, the idle gear 26 may serve as the first helical gear, while the first agitator gear 25 may serve as the second helical gear. In this example, the axis 26X corresponds to a second axis, whereas the axis 14X corresponds to a third axis. The first agitator gear 25 serves as an agitator gear.

More specifically, the small-diameter portion 26B of the idle gear 26 (first helical gear) is a helical gear with each gear tooth inclined relative to the first direction and the rotation direction of the idle gear 26. A first agitator gear 225 (second helical gear) includes a gear portion 225A serving as a helical gear with each gear tooth inclined relative to the first direction and a rotation direction of the first agitator gear 225.

As the first agitator gear 225 rotates in a first rotation direction D3, the gear portion 225A and the small-diameter portion 26B generate a first thrust force F3 that causes the first agitator gear 225 to move outward in the first direction. In other words, as the first agitator gear 225 rotates in the first rotation direction D3, the gear portion 225A and the small-diameter portion 26B generate the first thrust force F3 that causes the first agitator gear 225 to move toward the first gear cover 21 in the first direction. Accordingly, as the first agitator gear 225 rotates in the first rotation direction D3, the first agitator gear 225 and the idle gear 26 meshingly engage each other to generate the first thrust force F3, which causes the first agitator gear 225 to move toward the first position. The first position is farther away from an outer surface 211C of a container 211A in the first direction than the second position.

When the first agitator gear 225 arrives at the first position, the first agitator gear 225 comes into contact with the large-diameter portion 26A of the idle gear 26. The idle gear 26 is immovable in the axial direction relative to a housing 211, since the idle gear 26 is in contact with the first gear cover 21. Hence, the first agitator gear 25 is prevented from moving further outward in the first direction.

As the first agitator gear 225 rotates in a second rotation direction D4, the gear portion 225A and the small-diameter portion 26B generate a second thrust force F4 that causes the first agitator gear 225 to move inward in the first direction. In other words, as the first agitator gear 225 rotates in the second rotation direction D4, the gear portion 225A and the small-diameter portion 26B generate the second thrust force F4 that causes the first agitator gear 225 to move toward the outer surface 211C in the first direction. Accordingly, as the first agitator gear 225 rotates in the second rotation direction D4, the first agitator gear 225 and the idle gear 26 meshingly engage each other to generate the second thrust force F4. By the second thrust force F4, the first agitator gear 225 is moved toward the second position. The second position is closer to the outer surface 211C than the first position is to the outer surface 211C.

The first agitator gear 225 includes an engaging member 250A. The engaging member 250A has the same configuration as the engaging member 50 of the embodiment. The first agitator gear 225 has an end surface 225E facing a part of the outer surface 211C of the container 211A. The engaging member 250A is positioned at the end surface 225E. The engaging member 250A is thus rotatable about the axis 14X together with the first agitator gear 225. The engaging member 250A is also movable in the axial direction together with the first agitator gear 225.

The outer surface 211C of the container 211A has first holes 242. The first holes 242 have a similar configuration as the first holes 41 according to the embodiment described above, except that each of the first holes 242 of this variation has a closed bottom. That is, the first holes 242 are recesses that do not penetrate through the outer surface 211C in the axial direction.

In the embodiment described above, the first bearing member 27 serves as a portion of the housing 11 that is engageable with the engaging member 50. However, a portion of the housing 11 other than the first bearing member 27 may be configured to engage the engaging member 50. For example, as in this example of FIG. 8, the portion of the housing 11 engageable with the engaging member 50 may be a portion of the container 11A other than the first bearing member 27. Alternatively, the cover 11B may serve as the portion configured to engage the engaging member 50.

While the first agitator gear 225 is at the first position, the engaging member 250A is disengaged from the first holes 242 of the outer surface 211C. The first agitator gear 225 is therefore rotatable in accordance with rotations of the idle gear 26 and the developing gear 23, for example. While the first agitator gear 225 is at the second position, the engaging member 250A is in engagement with the first holes 242. The engaging member 250A is thus prevented from rotating further, thereby preventing further rotation of the first agitator gear 225 in the second rotation direction D4.

Other variations and modifications are also conceivable.

For example, the developing gear 23 may serves as the second helical gear, instead of the supply gear 24 and the first agitator gear 225. Still alternatively, the coupling 22 or the idle gear 26 may serve as the second helical gear. Further, the first helical gear may be any gear, provided that the gear meshingly engages the second helical gear. For example, in a case that a coupling serves as the second helical gear, a developing gear may serve as the first helical gear.

Further, while the plurality of first holes 41 are provided at the first bearing member 27 in the depicted embodiment, a single first hole may be formed in the first bearing member 27. Likewise, the engaging member 50 may include a single first protrusion, instead of the plurality of first protrusions 51 of the embodiment.

In the embodiment described above, both of the second surface 41B of each first hole 41 and the fourth surface 51B of each first protrusion 51 are inclined surfaces that are inclined relative to the rotation direction of the supply gear 24. However, only one of a second surface and a fourth surface may be inclined surfaces.

In the embodiment described above, the part of the outer surface 11C of the housing 11 (first bearing member 27) has the first holes 41, while the engaging member 50 includes the first protrusions 51. Alternatively, a part of the outer surface of a housing may have protrusions, while an engaging member may have holes configured to engage the protrusions of the housing. Specifically, the part of the outer surface may have a second protrusion having a first surface and a second surface, while the engaging member may have a third hole having a third surface and a fourth surface. A single second protrusion or a plurality of second protrusions may be provided at the outer surface. Likewise, a single third hole or a plurality of third holes may be formed at the engaging member. Still alternatively, the part of the outer surface of the housing and the engaging member may both have protrusions engagable each other. Specifically, the engaging member may include a first protrusion having a third surface and a fourth surface, while the part of the outer surface may include a second protrusion having a first surface and a second surface.

In the embodiment described above, the engaging member 50 is integrally formed with the supply gear 24 serving as the second helical gear. However, the engaging member and the second helical gear may be separate components.

In the embodiment described above, the developing cartridge 10 and the drum cartridge 5 are separate components. However, the developing cartridge 10 and the drum cartridge 5 may be integrally formed as a single component.

The monochrome laser printer 1 is described as an example of an image forming apparatus of the disclosure. However, the image forming apparatus of the disclosure may be a color image forming apparatus, an image forming apparatus configured to perform exposure with LEDs, a copying machine, or a multifunction device.

It should be apparent to those who skilled in the art that the embodiment and variations described above may be combined with one another as appropriate.

<Remarks>

The developing cartridge 10 is an example of a developing cartridge. The housings 11, 211 are examples of a housing. The outer surfaces 11C, 211C are examples of an outer surface. The developing roller 12 is an example of a developing roller. The first axis 12X is an example of a first axis. The coupling 22 and idle gear 26 are examples of the first helical gear. The axes 22X, 26X are examples of a second axis. The supply gear 24 and first agitator gear 225 are examples of the second helical gear. The end surfaces 24E and 225E are examples of an end surface. The first rotation directions D1, D3 are examples of a first rotational direction. The second rotation directions D2, D4 are examples of a second rotational direction. The axes 13X, 14X are examples of a third axis. The first thrust forces F1, F3 are examples of a first thrust force. The second thrust forces F2, F4 are examples of a second thrust force. The engaging members 50, 250A are examples of an engaging member. The first surface 41A and second surface 41B are examples of a first surface and a second surface, respectively. The third surface 51A and fourth surface 51B are examples of a third surface and a fourth surface, respectively. The first holes 41 are an example of a first hole. The first protrusions 51 are an example of a first protrusion. The supply roller 13 is an example of a supply roller. The agitator 14 is an example of an agitator. The developing gear 23 is an example of a developing gear. The first bearing member 27 is an example of a bearing member. The second insertion hole H2 is an example of a second hole. The first recess 22A is an example of a recess. The drum cartridge 5 is an example of a drum cartridge. The photosensitive drum 5B is an example of a photosensitive drum. The pressing member 5C is an example of a pressing member.

What is claimed is:

1. A developing cartridge comprising:

a housing configured to accommodate toner therein, the housing having an outer surface;

a developing roller rotatable about a first axis extending in an axial direction;

a first helical gear positioned at the outer surface and rotatable about a second axis extending in the axial direction, the first helical gear being rotatable in accordance with rotation of the developing roller;

a second helical gear positioned at the outer surface and rotatable in a first rotational direction and a second rotational direction opposite to the first rotational direction about a third axis extending in the axial direction, the second helical gear being movable in the axial direction between a first position and a second position positioned closer to the outer surface than the first position is to the outer surface, the second gear being moved to the first position by a first thrust force generated by the meshing engagement between the first helical gear and the second helical gear in a case where the second helical gear rotates in the first rotational direction, the second helical gear being moved to the second position by a second thrust force generated by the meshing engagement between the first helical gear and the second helical gear in a case where the second helical gear rotates in the second rotational direction; and an engaging member rotatable about the third axis together with the second helical gear and movable in the axial direction together with the second helical gear, the second helical gear being rotatable in the first rotational direction in accordance with the rotation of the first helical gear in a case where the second helical gear is at the first position, the engaging member being engaged with a part of the outer surface to terminate the rotation of the second helical gear in the second rotational direction in a case where the second helical gear is at the second position.

2. The developing cartridge according to claim 1, wherein the engaging member is configured to disengage from the part of the outer surface in the case where the second helical gear is at the first position.

3. The developing cartridge according to claim 1, wherein the engaging member is positioned at the second helical gear.

4. The developing cartridge according to claim 1, wherein the second helical gear has an end surface facing the part of the outer surface in the axial direction;

wherein the engaging member is positioned at the end surface; and wherein the part of the outer surface includes a first surface and a second surface, the first surface being configured to contact the engaging member to terminate the rotation of the second helical gear when the second helical gear rotates in the second rotational direction, and the second surface being configured to contact the engaging member to move the second helical gear and the engaging member toward the first position in the case where the second helical gear rotates in the first rotational direction.

5. The developing cartridge according to claim 4, wherein the part of the outer surface has a first hole having the first surface and the second surface.

6. The developing cartridge according to claim 5, wherein the part of the outer surface has a plurality of the first holes aligned with one another in a rotating direction of the second helical gear including the first rotational direction and the second rotational direction.

7. The developing cartridge according to claim 4, wherein the engaging member has a third surface configured to contact the first surface, and a fourth surface configured to contact the second surface.

8. The developing cartridge according to claim 7, wherein the engaging member comprises a first protrusion having the third surface and the fourth surface.

9. The developing cartridge according to claim 8, wherein the engaging member comprises a plurality of the first protrusions aligned with one another in a rotating direction of the second helical gear including the first rotational direction and the second rotational direction.

10. The developing cartridge according to claim 1, further comprising a supply roller rotatable about the third axis, the supply roller comprising a supply roller shaft defining the third axis, wherein the second helical gear is a supply gear mounted to the supply roller shaft.

11. The developing cartridge according to claim 10, further comprising a bearing member having a second hole in which the supply roller shaft is inserted, the bearing member constituting the part of the outer surface.

12. The developing cartridge according to claim 10, wherein the first helical gear is a coupling configured to rotate the developing roller.

13. The developing cartridge according to claim 12, wherein the developing roller comprises a developing roller shaft defining the first axis, the developing cartridge further comprising a developing gear mounted to the developing roller shaft, the coupling being meshingly engaged with the developing gear.

14. The developing cartridge according to claim 12, wherein the coupling has one end portion in the axial direction, the one end portion having a recess configured to receive a driving force.

15. The developing cartridge according to claim 1, further comprising an agitator rotatable about the third axis, the agitator comprising an agitator shaft defining the third axis, wherein the second helical gear is an agitator gear mounted to the agitator shaft.

16. The developing cartridge according to claim 15, wherein the first helical gear is an idle gear.

17. The developing cartridge according to claim 16, further comprising a coupling configured to rotate the developing roller, wherein the idle gear is meshingly engaged with the coupling.

18. The developing cartridge according to claim 17, wherein the developing roller comprises a developing roller shaft defining the first axis, the developing cartridge further comprising a developing gear mounted to the developing roller shaft, the coupling being meshingly engaged with the developing gear.

19. The developing cartridge according to claim 17, wherein the coupling has one end portion in the axial direction, the one end portion having a recess configured to receive a driving force.

20. The developing cartridge according to claim 1, wherein the developing cartridge is attachable to and detachable from a drum cartridge including a photosensitive drum and a pressing member configured to press the developing roller against the photosensitive drum; and wherein the developing roller is pressed against the photosensitive drum in a state where the developing cartridge is attached to the drum cartridge.

* * * * *